US009217957B2

(12) United States Patent
Ishida

(10) Patent No.: US 9,217,957 B2
(45) Date of Patent: Dec. 22, 2015

(54) DEVELOPMENT DEVICE, AND IMAGE FORMING APPARATUS

(71) Applicant: CANON KABUSHIKI KAISHA, Tokyo (JP)

(72) Inventor: Yusuke Ishida, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/330,147

(22) Filed: Jul. 14, 2014

(65) Prior Publication Data

US 2015/0030354 A1 Jan. 29, 2015

(30) Foreign Application Priority Data

Jul. 23, 2013 (JP) ..... 2013-152424

(51) Int. Cl.
*G03G 15/08* (2006.01)
*G03G 15/09* (2006.01)

(52) U.S. Cl.
CPC ..... *G03G 15/0921* (2013.01); *G03G 15/0887* (2013.01); *G03G 15/0891* (2013.01)

(58) Field of Classification Search
CPC ..... G03G 15/0887; G03G 15/0891; G03G 15/0921
USPC ..... 399/254, 256
See application file for complete search history.

(56) References Cited

U.S. PATENT DOCUMENTS

2010/0028052 A1* 2/2010 Akedo ..... 399/254
2014/0233985 A1* 8/2014 Wada et al. ..... 399/255

FOREIGN PATENT DOCUMENTS

JP 2010-044335 A 2/2010
JP 2010-237328 A 10/2010
JP 2010-256701 A 11/2010
JP 5414325 B2 2/2013
JP 5430214 B2 2/2014

OTHER PUBLICATIONS

Yusuke Ishida, et al., U.S. Appl. No. 14/534,707, filed Nov. 6, 2014.
Hisashi Tsukijima et al., U.S. Appl. No. 14/548,773, filed Nov. 20, 2014.

* cited by examiner

*Primary Examiner* — Erika J Villaluna
(74) *Attorney, Agent, or Firm* — Fitzpatrick, Cella, Harper & Scinto

(57) ABSTRACT

A development device includes a developer container that can store developer, a conveyance portion arranged rotatable in a storage portion formed with a discharge opening, and conveying the developer toward an end, on which the discharge opening is formed, in the longitudinal direction, a conveyance screw including a return screw that applies force of pushing back a flow of the developer, which moves toward the discharge opening, in the opposite direction, and a magnet member provided in the developer container in the vicinity of a level of the developer on at least the return portion. A magnetic brush formed by the magnetic force of the magnet member interferes with the return portion.

8 Claims, 13 Drawing Sheets

DEVELOPMENT DEVICE, AND IMAGE FORMING APPARATUS

BACKGROUND OF THE INVENTION

1. Field of the Invention

The present invention relates to a development device used for a copying machine or a laser beam printer employing an electrostatic recording system or an electrophotographic system for developing an electrostatic latent image, formed on an image bearing member, with developer including toner and carrier, and an image forming apparatus including the development device.

2. Description of the Related Art

Conventionally, an image forming apparatus such as a copying machine or a printer generally forms an electrostatic image onto an electrophotographic photosensitive member that is an image bearing member of a rotary drum, and develops the electrostatic image with developer to make the electrostatic image visible. So-called two-component developer containing non-magnetic toner and magnetic carrier has been widely used as the developer used in this type of the image forming apparatus.

A development system using two-component developer does not need to use magnetic toner. Therefore, this development system has advantages of providing stable image quality and durability of the apparatus, compared to the other development systems. However, deterioration in carrier is unavoidable in the two-component developer. Due to the repeated development, the non-magnetic toner is supplied in an amount used for the development, but the magnetic carrier is not used up and circulates in a developer container. Therefore, the deterioration of old carrier due to long-term durability has been unavoidable. In view of this, an image forming apparatus using the two-component developer has to discharge old carriers and supply fresh carriers for maintaining charging performance of the magnetic carrier.

Japanese Patent Laid-Open No. 2010-256701 describes a configuration in which developer containing toner in an amount used for a development operation of a development device and carriers in a fixed ratio is supplied to a development device, and surplus developer in the development device is discharged to a waste developer storage container arranged at the outside of the development device. Specifically, the developer is supplied, and almost at the same time, the surplus developer is discharged. With this, fresh carriers are supplied with the supply of toner, whereby the performance of the whole developer can be stabilized.

The development device that supplies and discharges developer includes a development chamber that supplies the developer to a photosensitive drum, and a stirring chamber that supplies the developer to the development chamber, wherein the development chamber and the stirring chamber are separated by a partition wall. A conveyance screw is provided in the respective chambers. The development chamber and the stirring chamber communicate with each other at both ends in the longitudinal direction, and the developer that is stirred and conveyed by the conveyance screw is circulated. Two-component developer is supplied from the upstream side in the conveyance direction by the conveyance screw in the stirring chamber, and the developer circulated in the developer container is discharged, little by little, from a discharge opening formed on an end surface at the downstream side.

As illustrated in FIG. 5, a conveyance screw 6 includes a helical conveyance portion 11 that conveys the developer in the direction of circulating the developer to the discharge opening, and a helical return screw 10 that is coupled to the downstream portion of the conveyance portion 11 for conveying the developer in a direction opposite to the conveyance direction of the conveyance portion 11. The return screw 10 pushes back most of the developer conveyed by the conveyance portion 11 toward the discharge opening in order to prevent excessive discharge of the developer from the discharge opening. The developer climbing over the return screw 10 is conveyed by a discharge screw 9 and discharged from the discharge opening.

In the configuration including the return screw 10 as described above, a small clearance (about 1.0 mm) is formed between the return screw 10 and an inner wall of the developer container 2 as illustrated in FIG. 13. The clearance is formed to prevent interference between the return screw 10 and the inner wall of the developer container 2, considering the dimension tolerance of the return screw 10 and the developer container 2. When the return screw 10 interferes with the inner wall of the developer container 2, an aggregate of the developer might be generated on the interference portion, and the generated aggregate might cause an image failure such as stain by toner.

On the other hand, when the clearance is formed between the return screw and the developer container as described above, the developer might leak from the clearance illustrated in FIG. 13. When the leakage of the developer occurs, the developer is discharged upon driving the development device, with the result that the developer in the development device might be exhausted. As a result, the developer coating on the development sleeve becomes insufficient, so that an image density might be uneven.

The phenomenon of the leakage of the developer is likely to occur at an upper part of the clearance as indicated by C portion in FIG. 13. On the other hand, the lower part of the clearance is packed by the developer due to its own weight, whereby the leakage of the developer at this portion hardly occurs.

In view of this, an apparatus including a non-contact restriction member provided for the return screw 10 at the clearance has been proposed (Japanese Patent Laid-Open No. 2010-237328). However, it is difficult to completely prevent the leakage of the developer, since a clearance is also formed between the restriction member and the container.

SUMMARY OF THE INVENTION

It is desirable to provide a development device that employs a development system of discharging developer and that can prevent a leakage of developer, and an image forming apparatus including the development device.

In order to achieve the above, a development device, which develops an electrostatic image formed on an image bearing member with developer in a developer container, includes: a developer container configured to be capable of storing developer, and include a first storage portion and a second storage portion, which are arranged side by side in a longitudinal direction across a partition wall, wherein the stored developer can be circulated between the first storage portion and the second storage portion by a communicating portion formed on both ends of the partition wall in the longitudinal direction; a discharge opening of the developer formed on one end of the first storage portion or the second storage portion in the longitudinal direction; a conveyance member that is rotatably arranged in the storage portion on which the discharge opening is formed, and that includes a conveyance portion configured to convey the developer toward the end on which the discharge opening is formed in the longitudinal direction and a return portion configured to apply force of pushing back a flow of the developer, which moves toward the discharge opening, in the opposite direction; and a magnet member configured to form a magnetic brush which contacts with the return portion above a rotation center of the return portion.

Further features of the present invention will become apparent from the following description of exemplary embodiments with reference to the attached drawings.

DESCRIPTION OF THE EMBODIMENTS

A development device according to the present invention will be described next in detail with an image forming apparatus including the development device.

First Embodiment

Image Forming Apparatus

Figure 1:
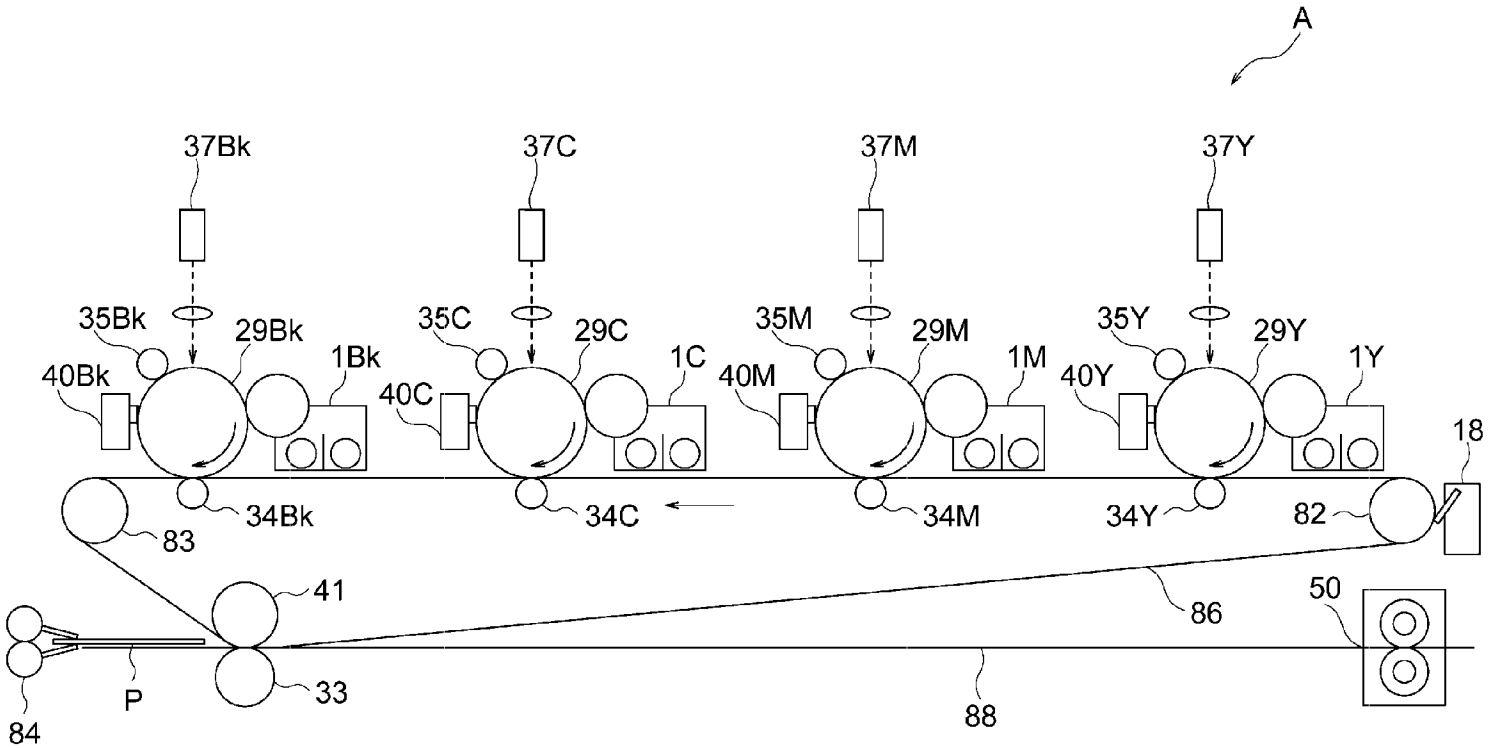
FIG. 1 is a diagram illustrating a schematic configuration of an image forming apparatus.

Firstly, an overall configuration and an operation of an image forming apparatus according to the present embodiment will be described. FIG. 1 is a diagram schematically illustrating a configuration of an image forming apparatus A according to the present embodiment.

The image forming apparatus A according to the present embodiment is a full-color printer of an electrophotographic system including four image forming portions provided corresponding to four colors that are yellow, magenta, cyan, and black. The image forming apparatus A includes four image forming portions that form images of yellow Y, magenta M, cyan C, and black Bk. Each image forming portion has substantially the similar configuration, except that a developed color is different. When the image forming portions need not be distinguished from one another, indexes Y, M, C, and Bk attached to the numeral for indicating a component belonging to any one of the image forming portions are omitted, and the image forming portion is collectively described.

Each of the image forming portions includes a cylindrical photosensitive member, i.e., a photosensitive drum 29, serving as an image bearing member. The photosensitive drum 29 is rotated in a direction of an arrow in the figure.

A charging roller 35 serving as a charging member, a development device 1 serving as a development portion, a primary transfer roller 34 and a secondary transfer roller 33, which serve as a transfer member, a secondary transfer counter roller 41, and a cleaning device 40 serving as a cleaning portion are provided around the photosensitive drum 29.

A laser scanner 37 serving as an exposure portion is arranged above the photosensitive drum 29 in the figure. An intermediate transfer belt 86 is arranged opposite to the photosensitive drum 29 in each image forming portion.

For a full-color image formation using four colors, the surface of the rotating photosensitive drum 29 is uniformly charged by the charging roller 35, and is exposed with laser light corresponding to an image signal issued from the laser scanner 37. Thus, an electrostatic image (latent image) according to the image signal is formed on the photosensitive drum 29. The electrostatic image on the photosensitive drum 29 is visualized with toner stored in the development device 1 to become a visible image (toner image).

The toner image is primarily transferred onto the intermediate transfer belt 86. Toner remaining on the surface of the photosensitive drum 29 after the primary transfer is removed by the cleaning device 40.

The operation described above is successively carried out for yellow, magenta, cyan, and black, and the toner images of four colors are superimposed on the intermediate transfer belt 86. The intermediate transfer belt 86 moves in a counterclockwise direction in the figure by a drive roller 83 to convey the toner images to the secondary transfer portion.

On the other hand, a recording material P stored in a recording material storage cassette (not illustrated) is conveyed by a feed roller 84 and a conveyance guide 88 on a timing of forming the toner image. A secondary transfer bias is applied to the secondary transfer roller 33, whereby the toner images of four colors on the intermediate transfer belt 86 are secondarily transferred onto the recording material P carried on the conveyance guide 88 at one time.

Next, the recording material P is conveyed to a fixing device 50 serving as a fixing portion. The fixing device applies heat and pressure, whereby the toner on the recording material P is fused and mixed. Thus, a full-color permanent image is formed. Then, the recording material P is discharged to the outside of the apparatus.

The toner that is not transferred at the secondary transfer portion and remains on the intermediate transfer belt 86 is removed by an intermediate transfer belt cleaner 18. Thus, a series of operations is ended.

An image of a single desired color or an image of desired multi colors can also be formed by using only the desired image forming portion.

Development Device

Next, a configuration of the development device according to the present embodiment will be described. FIGS. 2 to 6 are views schematically illustrating the development device according to the present embodiment.

Figure 2:
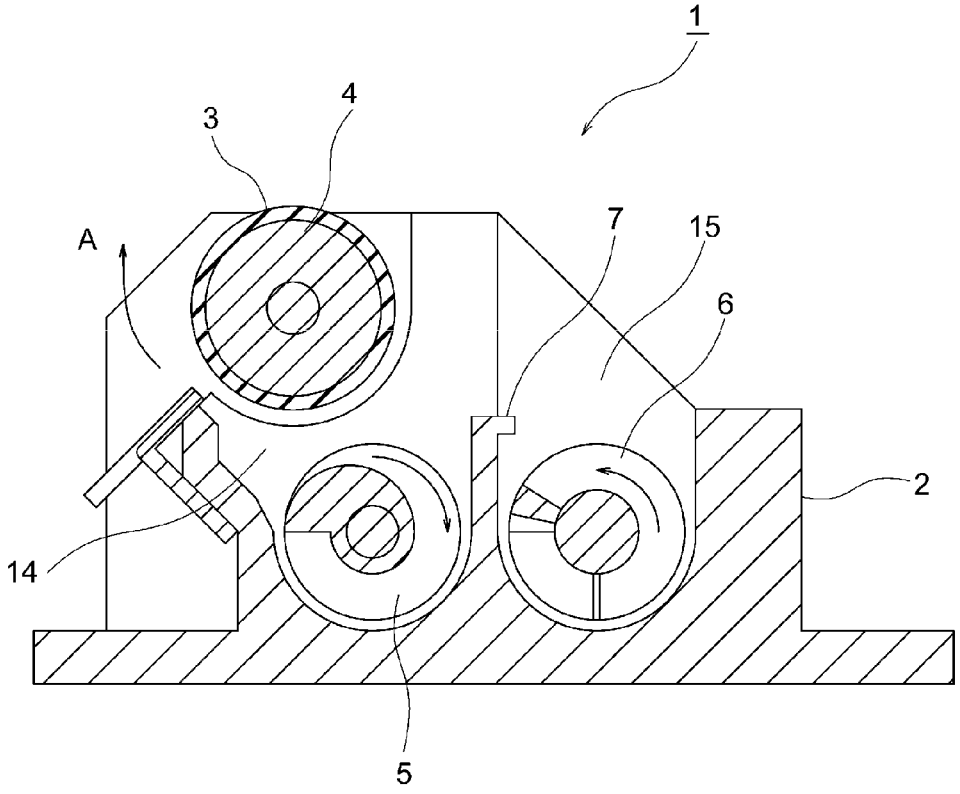
FIG. 2 is an explanatory view illustrating a cross-section of a development device.

An overall configuration of the development device according to the present embodiment will be described with reference to FIGS. 2 and 3. FIG. 2 illustrates a cross-section of the development device 1 viewed from a back side of the image forming apparatus body, wherein the near side in FIG. 2 corresponds to the back side of the apparatus body.

The development device according to the present embodiment stores developer, which is two-component developer including non-magnetic toner and magnetic carrier, in a developer container 2. In the developer according to the present embodiment, a mixture ratio by weight of toner and carrier is about 1:9. This ratio should properly be adjusted based upon a charging amount of toner, particle diameter of carrier, and the configuration of the image forming apparatus 24, and this ratio is not necessarily limited to this value.

A portion of a development region, which is opposite to the photosensitive drum 29, of the developer container 2 in the development device 1 is open, and a development sleeve 3, which includes a magnet 4 arranged in a non-rotatable manner and serves as a developer bearing member, is rotatably mounted with a part of the development sleeve 3 being exposed to the opening portion.

The development sleeve 3 is made of a non-magnetic material. The development sleeve 3 rotates in a direction of an arrow A during a development operation, forms and holds layers of the two-component developer in the developer container 2, conveys the layered two-component developer onto the development region, and supplies the developer onto the photosensitive drum 29 at the development region to develop an electrostatic latent image formed on the photosensitive drum 29. The developer remaining after the development of the electrostatic image is collected into the developer container 2 with the rotation of the development sleeve 3.

Figure 3:
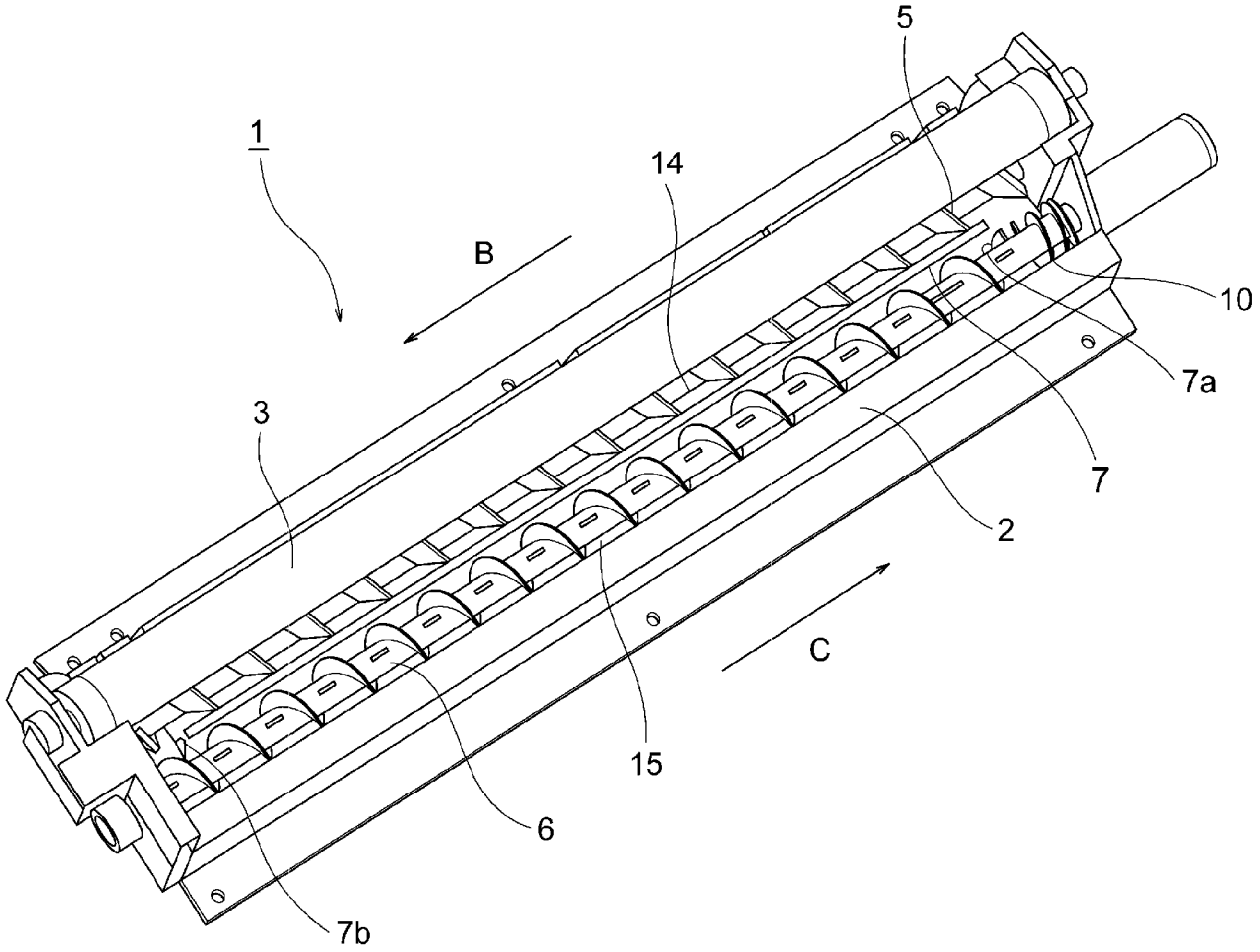
FIG. 3 is a perspective explanatory view of the development device.
Figure 4:
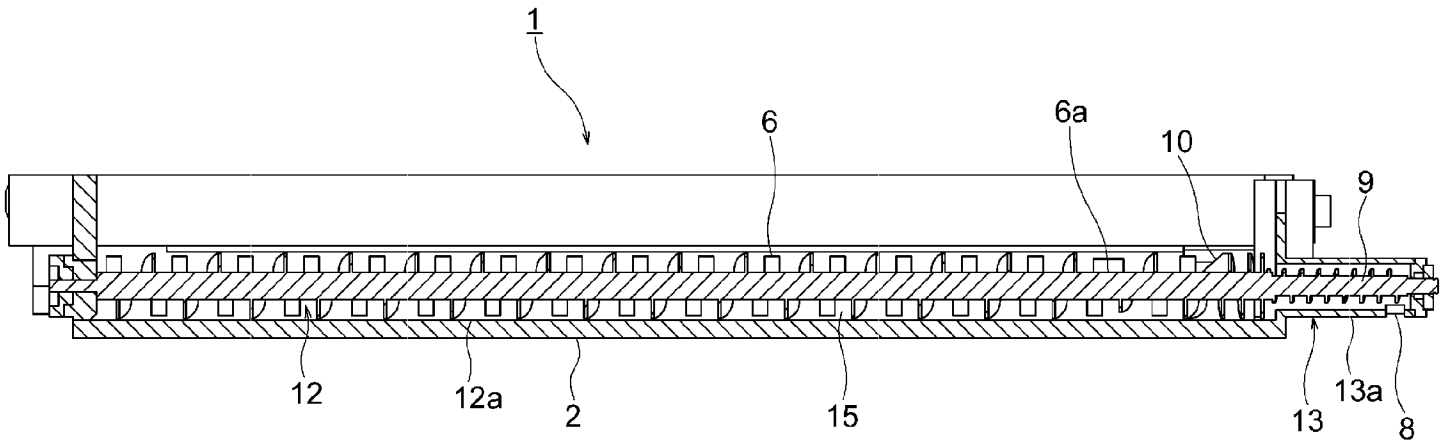
FIG. 4 is an explanatory view illustrating a cross-section of the development device in a longitudinal direction.
Figure 5:
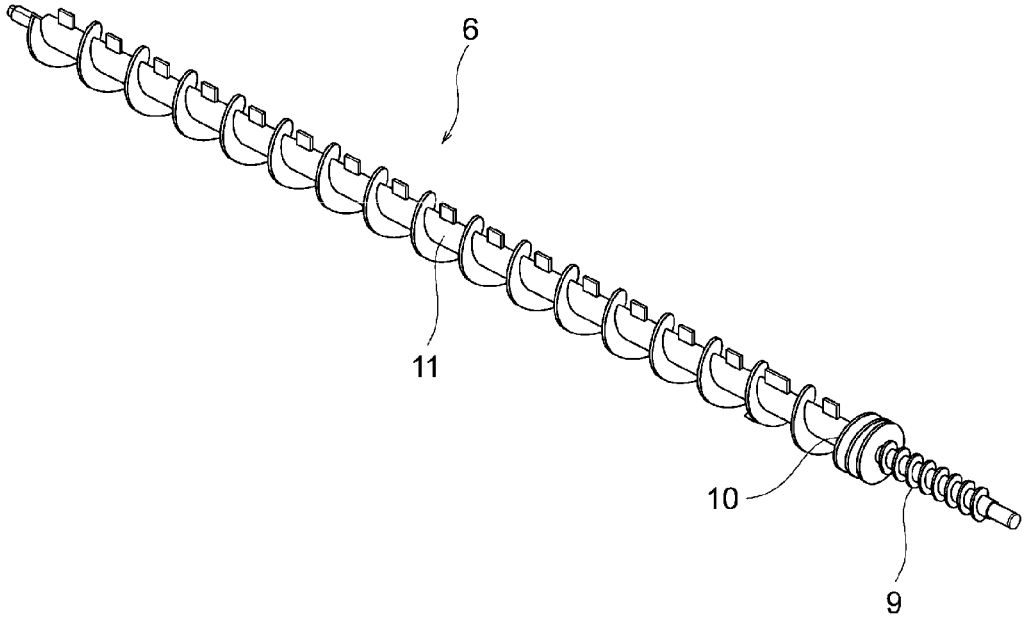
FIG. 5 is an explanatory view illustrating a conveyance screw.
Figure 6:
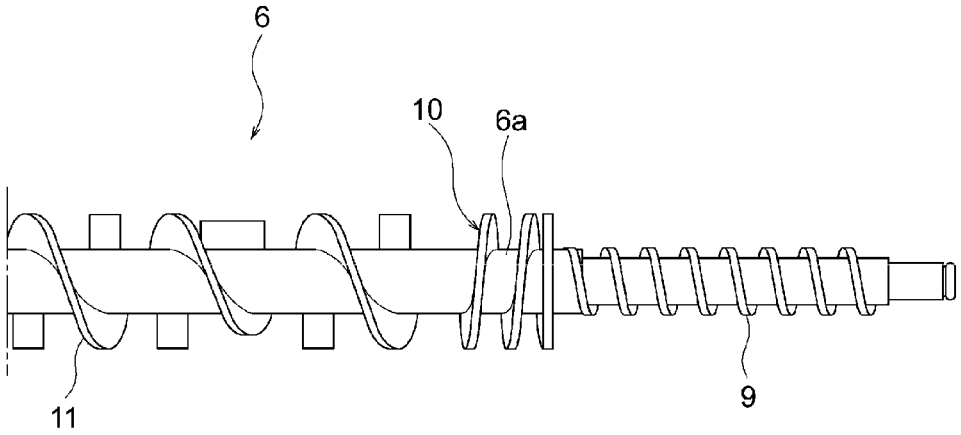
FIG. 6 is a partially enlarged view of the conveyance screw.

As illustrated in FIG. 3, the developer container 2 includes a development chamber 14 serving as a first storage portion that can store the developer, and a stirring chamber 15 serving as a second storage portion that is provided adjacent to the development chamber 14 across a partition wall 7 in a longitudinal direction and that can store the developer. The development chamber 14 and the stirring chamber 15 communicate with each other via opening portions 7*a* and 7*b* that are formed on both ends of the partition wall in the longitudinal direction and serve as a communicating portion. With this configuration, the stored developer can circulate between the development chamber 14 and the stirring chamber 15. The development chamber 14 and the stirring chamber 15 are provided with a first conveyance screw 5 and a second conveyance screw 6, which are conveyance members for stirring and conveying the stored developer. A supply port (not illustrated) for supplying developer containing toner and carrier is formed in the stirring chamber 15. As illustrated in FIG. 4, a discharge opening 8 from which the developer is discharged is formed on one end of the stirring chamber 15 in the longitudinal direction.

The discharge opening 8 is formed at the outside of the circulation path in the stirring chamber 15 at the downstream side in the developer conveyance direction. A rotation shaft 6*a* of the second conveyance screw 6 is provided to be rotatable in the developer conveyance path between the circulation path and the discharge opening 8. The two-component developer is stirred and mixed by the first conveyance screw 5 and the second conveyance screw 6, and conveyed and circulated in the developer container 2. The developer is conveyed and circulated in a direction of an arrow B and a direction of an arrow C in FIG. 3.

Supply and Discharge of Developer

Supply and discharge of the developer to the stirring chamber 15 will be described next. As illustrated in FIG. 4, the rotation shaft 6*a* of the second conveyance screw 6 includes a conveyance portion 11, which includes a helical screw, for conveying the developer in the stirring chamber 15 from one end to the other end in the longitudinal direction. A return screw 10, which serves as a return portion for applying force for pushing back the conveyed developer in the opposite direction, is mounted at the downstream side of the conveyance portion 11 in the developer conveyance direction. A discharge screw 9, which serves as a discharge conveyance portion for conveying the developer climbing over the helical return screw 10 to the discharge opening 8, is also mounted continuously to the return screw 10.

A discharge path 13 for discharging the developer is formed on the portion, where the discharge screw 9 is provided, so as to be continuous with the conveyance path 12 formed on the stirring chamber 15. As illustrated in FIG. 4, a level of a bottom surface 13*a* of the discharge path 13 is higher than a level of a bottom surface 12*a* of the conveyance path 12 to prevent the developer in the conveyance path 12 from unnecessarily being conveyed to the discharge path 13. The developer conveyed to the discharge path 13 is conveyed to the discharge opening 8 by the discharge screw 9, thereby being discharged and collected.

The developer to be supplied contains carriers in toner in a fixed ratio (in the present embodiment, about 10% by weight). Toner in an amount corresponding to the toner used for the image formation is supplied, as the developer to be supplied containing carriers in a fixed ratio as described above, from an unillustrated developer supplying portion from the upstream side in the developer conveyance direction by the second conveyance screw 6 in the developer container 2.

When the developer is supplied for keeping the toner density in the developer in the developer container 2 constant, the amount of the developer in the developer container 2 increases with the image formation. The developer to be supplied contains 90% of toner and 10% of carriers. Therefore, toner is used up by the image formation, but the carriers are not used and remain in the developer container. When the developer is repeatedly supplied, the amount of the developer increases.

The developer circulates between the stirring chamber 15 and the development chamber 14, but when the amount of the developer becomes more than a predetermined amount, some developer climbs over the return screw 10. The developer climbing over the return screw 10 is conveyed to the discharge opening 8 by the discharge screw 9. The developer conveyed to the discharge opening 8 is discharged from the discharge opening 8, and conveyed to a collecting container (not illustrated) to be collected.

The two-component developer is automatically and gradually replaced to keep the developer in the developer container constant in such a manner that the used toner is replenished by the developer to be supplied, and simultaneously, the supplied developer having extra carriers is discharged. Thus, a developer automatic discharging function can be realized.

Magnetic Brush

A clearance is formed between the return screw 10 and an inner wall of the developer container 2. The clearance is formed to prevent the interference between the return screw 10 and the inner wall of the developer container 2, considering a dimension tolerance of the return screw 10 and the developer container 2 as described above. Since the clearance is formed, the developer might be leaked from the clearance.

Figure 7A:
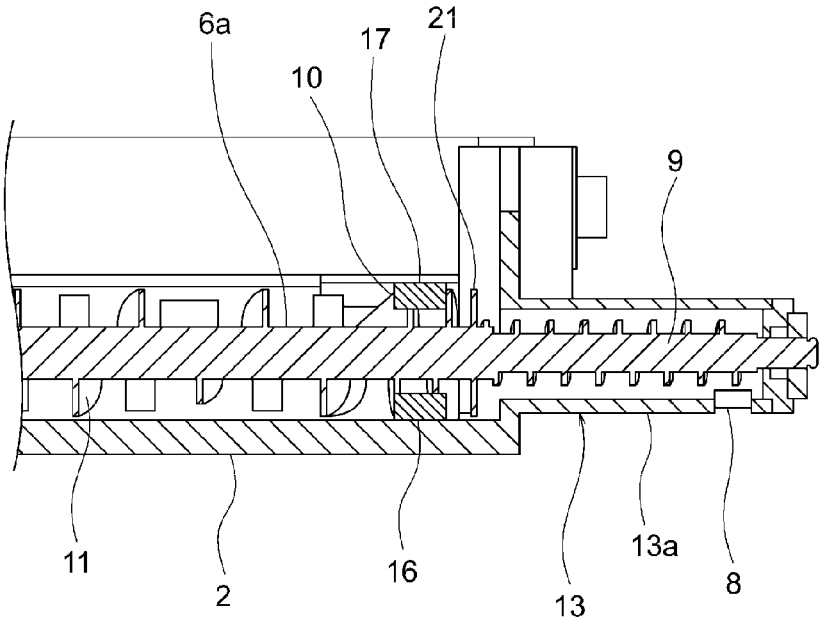
FIGS. 7A and 7B are explanatory views illustrating an arrangement of a magnet member according to a first embodiment.
Figure 7B:
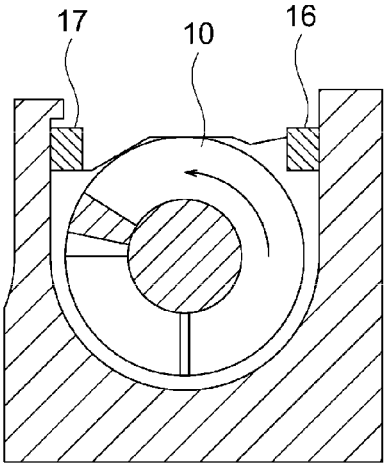

In the present embodiment, magnet members (magnetic force members) 16 and 17 are arranged on the inner wall of the developer container 2 and in the vicinity of the level of the developer at the return screw 10, as illustrated in FIGS. 7A and 7B. These magnet members 16 and 17 are arranged to exert their magnetic force to the return screw 10. Specifically, a magnetic brush formed by the magnetic force of the magnet members 16 and 17 is brought into contact with the return screw 10.

As illustrated in FIGS. 7A and 7B, the magnet members 16 and 17 are arranged at the upper part of the clearance formed by the return screw 10 and the developer container on both sides of the return screw 10, at the position where the return screw 10 is arranged. This is because the developer is likely to leak from the upper part of the clearance as described above. The lower part of the clearance is packed by the developer with the developer's own weight, resulting in that the developer hardly leaks from this portion. Therefore, the leakage of the developer hardly occurs, even if the magnetic brush is not formed on this portion.

As illustrated in FIG. 7B, a curtain of magnetic force is formed between the return screw 10 and the developer container 2 by arranging the above-mentioned magnet members 16 and 17 at the upper part of the clearance. The magnetic force curtain is formed such that the magnetic force is applied to the return screw 10. Thus, the magnetic brush curtain is formed on the clearance. The magnetic brush curtain prevents the leakage of the magnetized developer, which is likely to leak from the upper part of the clearance. Thus, the amount of the developer in the developer container is stabilized.

As illustrated in FIG. 7B, the magnet members 16 and 17 are arranged in quadrants; the magnet member 16 serving as a first magnetic force member is arranged in the first quadrant in a coordinate space made by horizontal and vertical planes with the rotation center axis of the return screw 10 being defined as an origin, in the present embodiment. The other magnet member 17 serving as a second magnetic force member is arranged in the second quadrant. No magnet members are arranged in the third and fourth quadrants. The reason of this is because the leakage of the developer hardly occurs in the third and fourth quadrants, since the lower part of the clearance is packed by the developer with the developer's own weight as described above.

Figure 8:
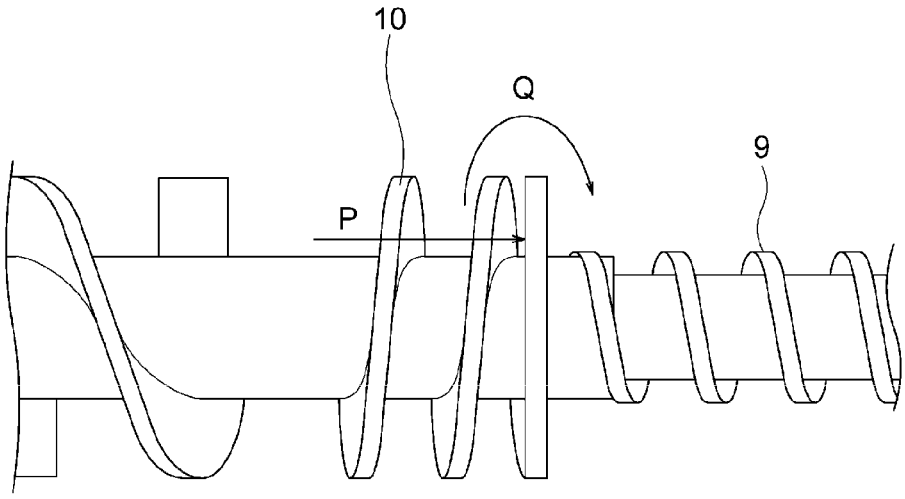
FIG. 8 is an explanatory view describing that developer climbs over a return screw.

The magnetic brush curtain is not formed above the apex of the return screw 10. Therefore, when fresh developer is supplied, and the developer in the developer container increases, the surplus developer is discharged by climbing over the apex of the return screw 10 as illustrated in FIG. 8. Accordingly, the magnetic brush curtain has no opportunity to interrupt the discharge of the surplus developer.

As described above, in the development device having a mechanism of replacing the developer by supplying and discharging the developer according to the present embodiment, the magnet members for forming the magnetic brush that is in contact with the return screw are provided on the surface of the container facing the return screw. With this configuration, the clearance between the return screw and the developer container is sealed by the magnetic brush curtain. Accordingly, this configuration can prevent the leakage of the developer without causing an aggregate of the developer.

Figure 9:
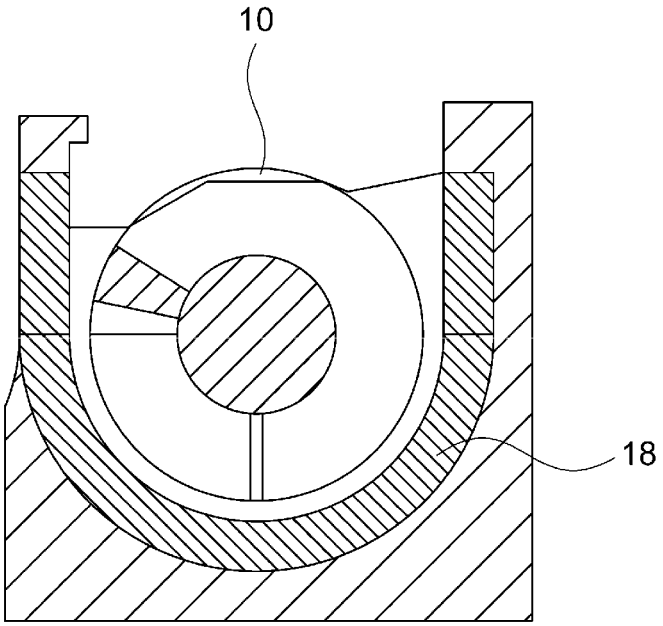
FIG. 9 is an explanatory view illustrating another example of an arrangement of a magnet member.

In the present embodiment, the magnet member 16 serving as the first magnetic force member is arranged in the first quadrant, and the magnet member 17 serving as the second magnetic force member is arranged in the second quadrant. This is because the lower part of the clearance is packed by the developer due to the developer's own weight. However, as illustrated in FIG. 9, a magnet member 18 may be arranged on the whole circumference of the container corresponding to the return screw 10, i.e., arranged not only in the first and second quadrants but also in the third and fourth quadrants.

Specifically, the magnet member may be arranged at any positions, so long as it can suppress the leakage amount of the developer to a desired amount. The magnet member is only necessarily arranged in at least the first quadrant and the second quadrant.

Second Embodiment

Next, a second embodiment will be described. An image formation process in the present embodiment is similar to that in the first embodiment, so that the redundant description will not be repeated, as the case may be.

Figure 10:
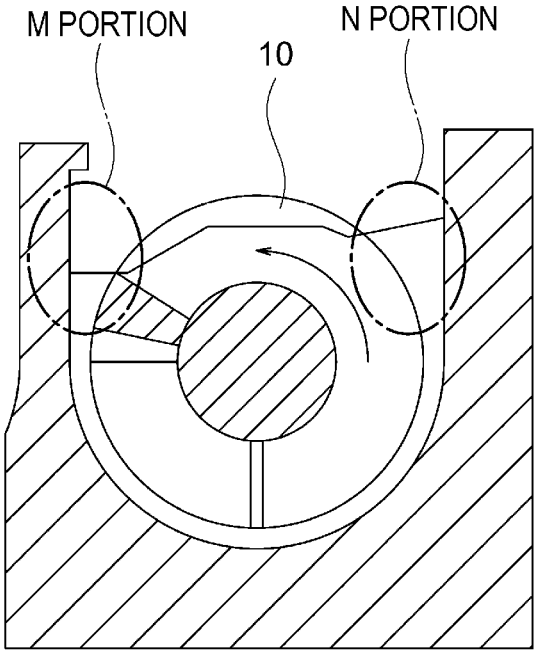
FIG. 10 is a view for describing a condition of the developer at the return screw.

As illustrated in FIG. 10, the level of the developer, which is conveyed by the return screw 10, at the upstream portion (N portion) in the rotating direction of the return screw 10 is slightly higher than the level of the developer at the downstream portion (M portion). This is because the developer is lifted up at the upstream portion and is pushed down at the downstream portion, by the rotation of the return screw 10. Therefore, the leakage of the developer hardly occurs at the downstream portion (M portion) in the rotating direction, while is more likely to occur at the upstream portion (N portion) than at the downstream portion.

Figure 11A:
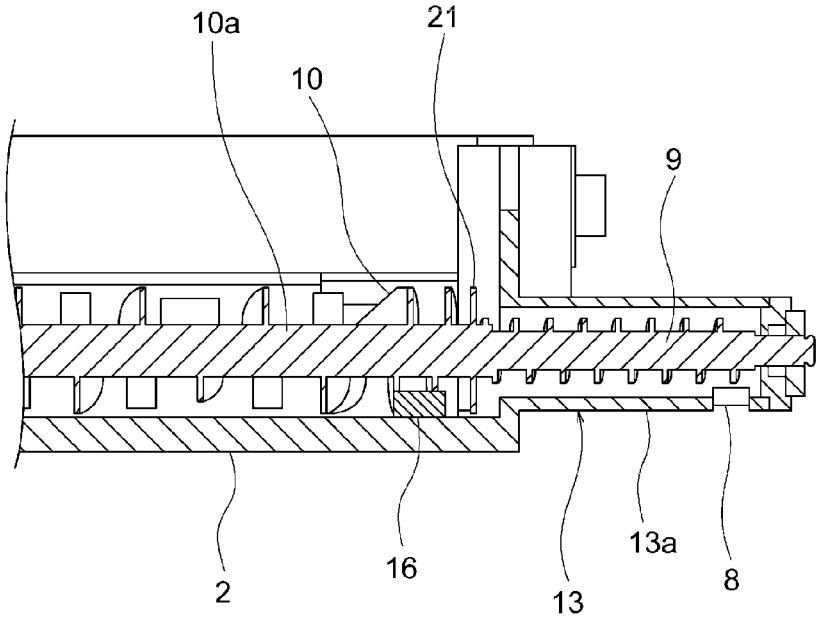
FIGS. 11A and 11B are explanatory views illustrating an arrangement of a magnet member according to a second embodiment.
Figure 11B:
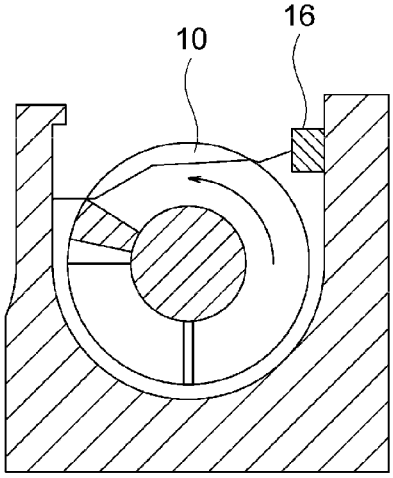

In view of this, in the present embodiment, the magnet member 16 is arranged only at the upstream portion (N portion) in the rotating direction of the return screw 10 at the upper part of the clearance as illustrated in FIGS. 11A and 11B. FIG. 11A is a view when the development device is viewed from the top surface.

The magnet member 16 is arranged at the upstream portion (N portion) in the rotating direction of the return screw 10, from which the developer is most likely to leak, at the upper part of the clearance. With this arrangement, the magnetic brush curtain is formed between the return screw and the developer container. The magnetic brush is formed to be in contact with the return screw 10, i.e., formed such that the magnetic force is applied up to the return screw 10. According to this configuration, the unnecessary leakage of the developer at the upper part of the clearance is prevented, whereby the amount of the developer in the developer container can be stabilized.

As described above, the magnet for forming the magnetic brush that is in contact with the return screw is mounted on the surface of the container facing the return screw in the development device having the automatic developer replacing mechanism. This configuration closes the clearance between the return screw and the container by the magnetic brush, thereby preventing the leakage of the developer without causing an aggregate of the developer.

As illustrated in FIG. 11B, as for the magnet employed in the present embodiment, the magnet member is arranged in the first quadrant in a coordinate space formed by horizontal and vertical planes with the rotation center axis of the return screw 10 being defined as an origin. However, the detail is not particularly limited, so long as the magnet can suppress the leakage amount of the developer to a desired amount. The detail is not particularly limited, so long as the magnet is arranged in the first quadrant.

Third Embodiment

A third embodiment will be described next. An image formation process in the present embodiment is similar to that in the first embodiment, so that the redundant description will not be repeated, as the case may be.

Figure 12A:
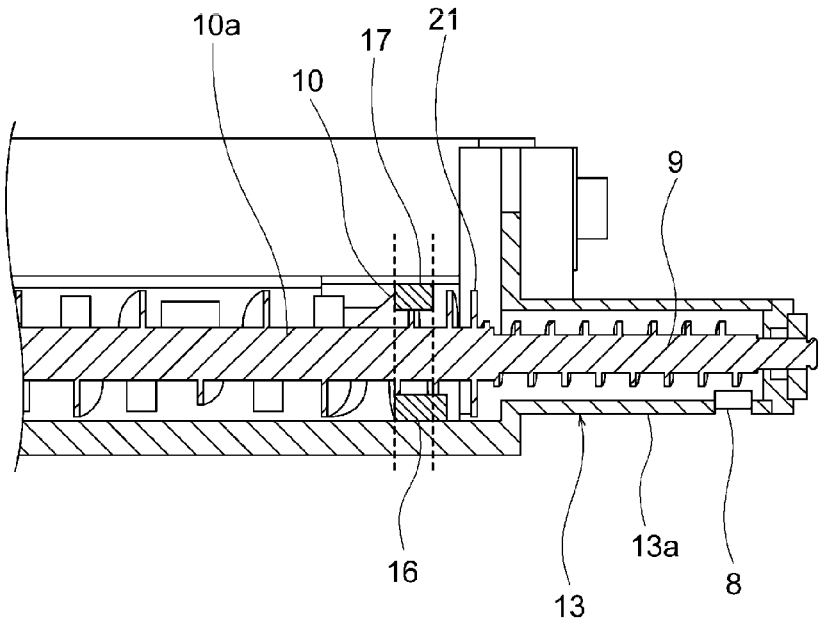
FIGS. 12A and 12B are explanatory views illustrating an arrangement of a magnet member according to a third embodiment.
Figure 12B:
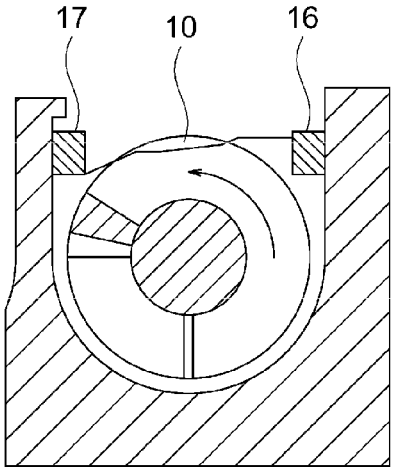
Figure 13:
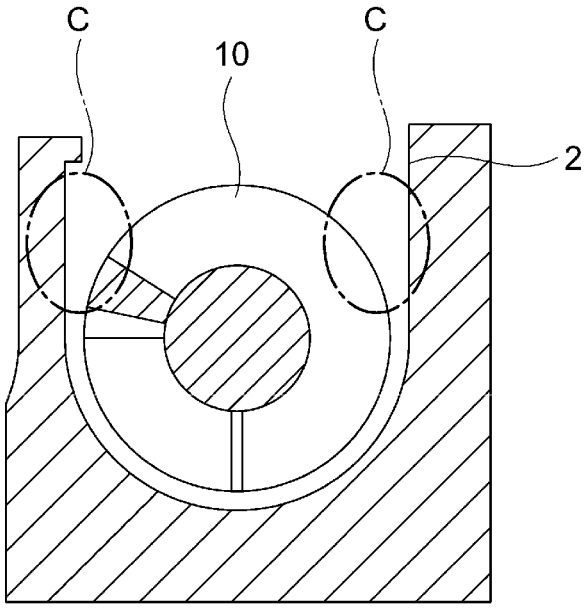
FIG. 13 PRIOR ART
FIG. 13 is an explanatory view illustrating a development device according to the related art.

As illustrated in FIG. 10, the level of the developer at the upstream portion (N portion) in the rotating direction of the return screw 10 is slightly higher than the level of the developer at the downstream portion (M portion). Therefore, the leakage of the developer is more likely to occur at the upstream portion (N portion) than at the downstream portion (M portion) in the rotating direction as described above. In view of this, as illustrated in FIGS. 12A and 12B, magnet members 16 and 17 are each provided at the upstream portion (N portion) and at the downstream portion (M portion) in the rotating direction of the return screw 10 at the upper part of the clearance. The volume of the magnet member 16 arranged at the upstream portion (N portion) in the rotating direction is set larger than the volume of the magnet member 17 arranged at the downstream portion (M portion). Specifically, the magnetic force of the upstream magnet member 16 is stronger than the magnetic force of the downstream magnetic member.

The magnet members 16 and 17 are arranged at the upper part of the clearance. With this arrangement, the magnetic brush curtain is formed between the return screw 10 and the developer container 2. The magnetic brush is formed to be in contact with the return screw 10. According to this configuration, the unnecessary leakage of the developer at the upper part of the clearance is surely prevented, whereby the amount of the developer in the developer container can be stabilized.

The volume of the magnet member 16 at the upstream portion is larger than the volume of the magnet member 17 at the downstream portion, whereby the magnetic force of the magnet member 16 becomes stronger than the magnetic force of the magnet member 17. Accordingly, the force of collecting the developer by the magnetic brush curtain is higher at the upstream portion than at the downstream portion, whereby the leakage of the developer can effectively be prevented.

As described above, the magnet for forming the magnetic brush that is in contact with the return screw is mounted on the surface of the container facing the return screw in the development device having the automatic developer replacing mechanism. This configuration closes the clearance between the return screw and the container by the magnetic brush, thereby preventing the leakage of the developer without causing an aggregate of the developer.

As illustrated in FIG. 12B, the magnet member employed in the present embodiment is arranged in the first quadrant and the second quadrant. However, the detail is not particularly limited, so long as the magnet member can suppress the leakage amount of the developer to a desired amount. The detail is not particularly limited, so long as the magnet member is arranged in the first quadrant and in the second quadrant.

In the present invention, the clearance between the return portion and the developer container is closed by the magnetic brush. This configuration can prevent the leakage of the developer without causing an aggregate of the developer.

While the present invention has been described with reference to exemplary embodiments, it is to be understood that the invention is not limited to the disclosed exemplary embodiments. The scope of the following claims is to be accorded the broadest interpretation so as to encompass all such modifications, equivalent structures and functions.

This application claims the benefit of Japanese Patent Application No. 2013-152424, filed Jul. 23, 2013, which is hereby incorporated by reference herein in its entirety.

What is claimed is:

1. A development device that develops an electrostatic image formed on an image bearing member with developer including a toner and magnetic carrier, the development device comprising:

a developer container configured to be capable of storing developer, and include a first storage portion and a second storage portion, which are arranged side by side across a partition wall, wherein a circulating path to circulate developer between the first storage portion and the second storage portion is formed by the partition wall;

a conveyance member which is rotatably disposed in the first storage portion to convey developer in the first storage portion, the conveyance member comprising a rotatable rotation shaft, a main spiral portion having a helical shape formed around the rotation shaft to convey developer in the circulating path in a circulating direction, and a sub spiral portion having a reverse helical shape of the main spiral portion formed around the rotation shaft at a downstream side of the main spiral portion in the circulating direction;

a supply opening through which magnetic carrier is supplied;

a discharge opening for discharge of developer climbing over the sub spiral portion outside the first storage portion in accordance with supplement of magnetic carrier from the supply opening, the discharge opening being formed at a position where the rotation shaft penetrates a side wall of the first storage portion at a downstream side in the circulating direction; and a magnet member configured to form a magnetic brush which contacts with the sub spiral portion above a rotation center of the sub spiral portion.

2. The development device according to claim 1, wherein the magnet member is arranged in at least a first quadrant located at an upstream side with request to a rotating direction of the sub spiral portion in a coordinate space formed by horizontal and vertical planes with the rotation center of the sub spiral portion being defined as an origin.

3. The development device according to claim 2, wherein the magnet member is also arranged in third and fourth quadrants in the coordinate space formed by horizontal and vertical planes with the rotation center of the sub spiral portion being defined as the origin.

4. The development device according to claim 1, wherein the magnet member includes a first magnet member arranged in a first quadrant located at an upstream side with respect to rotating direction of the sub spiral portion in a coordinate space formed by horizontal and vertical planes with the rotation center of the sub spiral portion being defined as an origin, and a second magnet member arranged in a second quadrant located at a downstream side in the rotating direction of the sub spiral portion in the coordinate space.

5. The development device according to claim 4, wherein the magnetic force of the first magnet member is larger than the magnetic force of the second magnet member.

6. The development device according to claim 1, wherein the conveyance member includes a discharge conveyance portion configured to convey the developer, which is conveyed by the main spiral portion and climbs over the sub spiral portion, to the discharge opening.

7. The development device according to claim 1, wherein the magnetic member is disposed to overlap the sub spiral portion in an axis direction of the rotation shaft.

8. The development device according to claim 7, wherein the magnetic member overlaps the sub spiral portion with a distance of more than a single helical pitch of the sub spiral portion in the axis direction of the rotation shaft.

* * * * *